United States Patent [19]

Swisher

[11] Patent Number: 4,475,365

[45] Date of Patent: Oct. 9, 1984

[54] ELECTRICAL BOX LOCK ASSEMBLY

[76] Inventor: James A. Swisher, 2497 Castellon Dr. North, Jacksonville, Fla. 32217

[21] Appl. No.: 286,583

[22] Filed: Jul. 24, 1981

[51] Int. Cl.[3] ..... B65D 55/14

[52] U.S. Cl. ..... 70/159; 70/63

[58] Field of Search ..... 70/159, 164, 232, 63, 70/371, 161, 230, 166, 170; 292/207, 208, 106, 104, 282–284, 205, 248

[56] References Cited

U.S. PATENT DOCUMENTS

| | | | |
|---|---|---|---|
| 1,343,851 | 6/1920 | Roe | 70/159 |
| 4,096,718 | 6/1978 | Michelman et al. | 292/284 X |
| 4,144,729 | 3/1979 | Nielsen | 292/284 |
| 4,254,647 | 3/1981 | Finck | 292/284 |

*Primary Examiner*—Robert L. Wolfe

*Attorney, Agent, or Firm*—Robert E. Ross

[57] ABSTRACT

A housing for receiving a lock of the so-called "barrel-lock" type for locking the hinged cover of an electric meter box or the like. The housing comprises a support block for attachment to the meter box, and a housing hinged to the block. The housing carries a meter box cover retainer which, when the housing is in the closed condition, extends in front of the cover to prevent it from being opened. Also when the housing is in the closed condition, the housing and the support block have aligned apertures to receive a lock of the "barrel-lock" type.

5 Claims, 4 Drawing Figures

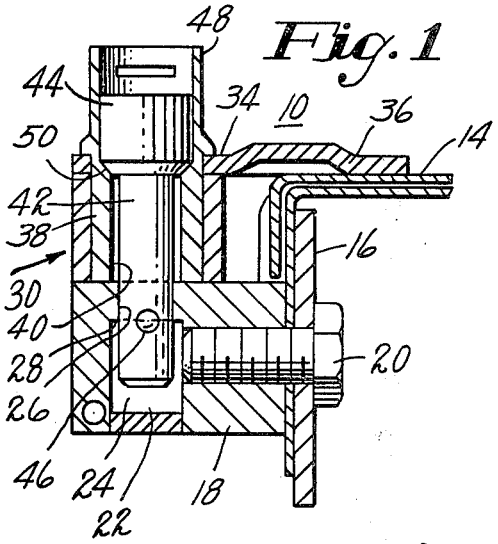
Fig. 1
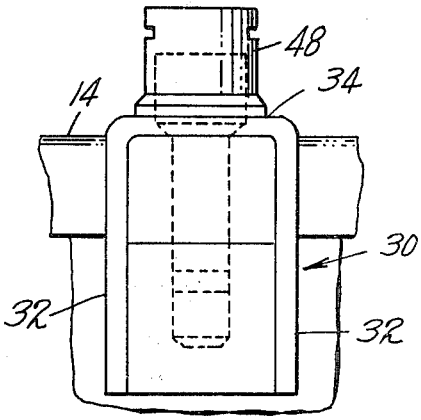
Fig. 2
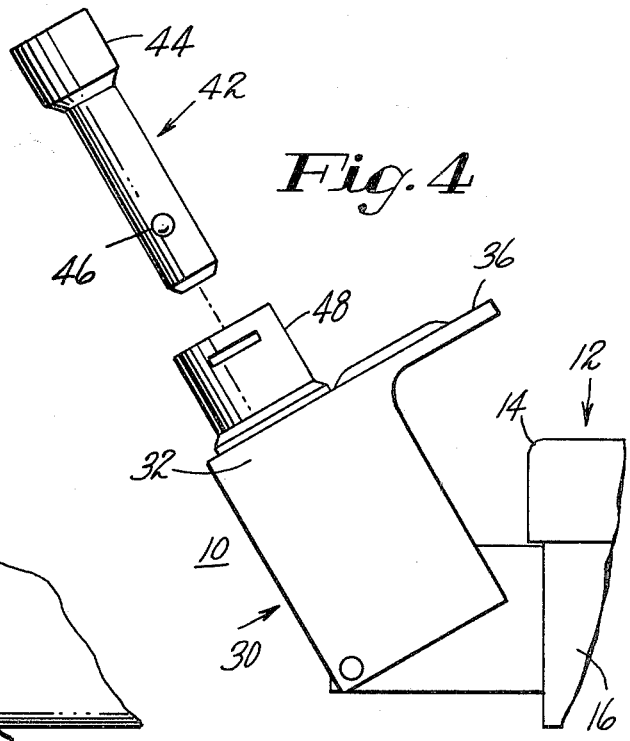
Fig. 4
Fig. 3
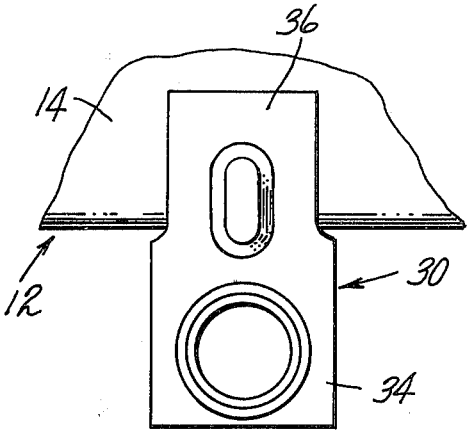

ELECTRICAL BOX LOCK ASSEMBLY

BACKGROUND OF THE INVENTION

Increasing vandalism and theft of electricity has created a need for better locks for electric meter boxes. In the past it has been common to provide a lock assembly which comprises a housing attached to the box in such a manner that the box cover cannot be opened when the housing is in place. The housing is locked in place by a lock of the so-called "barrel-lock" type.

Such devices that are now in use have the disadvantage that they must be disassembled from the box when it is necessary for service personnel to open the box, and they must then replace after closing the box cover. Such a procedure is not only time consuming but also has the possibility that components of the assembly can be misplaced or dropped and lost.

SUMMARY OF THE INVENTION

This invention provides a meter box lock asembly which is permanently assembled to the meter box, so that to open the box, it is not required to remove any component except the barrel lock itself. For this purpose, a support block is provided which is mounted into the side of the meter box, and a housing is hinged to the support block, said housing being capable of being pivoted between a locking and a non-locking position. The housing carries a meter box cover retainer, which when the housing is in the locking position, extends in front of the cover to prevent it from being opened, and when the housing is swung to the unlocking position, is out of the way of the cover. The housing and the support block each contain suitable aperture which are aligned when the housing is in the locking positioned, said apertures being dimensioned to receive a barrel lock.

Unlocking of the meter box cover therefore only requires that the barrel lock be removed, and the housing swing aside, to allow opening of the meter box cover.

BRIEF DESCRIPTION OF THE FIGURES OF THE DRAWING

FIG. 1 is a top plan view, partly in section, of a lock housing assembly embodying the features of the invention, assembled into a meter box, and disposed in the locked condition.

FIG. 2 is a view of FIG. 1 as seen from the left side.

FIG. 3 is a view of the assembly of FIG. 1 as seen from the top.

FIG. 4 is a view of the lock housing assembly in the open or unlocked position.

Referring to the drawing, there is illustrated a meter box locking assembly 10, which is designed for assembly into a meter box 12 to retain the cover 14 thereof in the closed position.

The assembly 10 is intended for attachment onto a side wall 16 of the box 12, on the side oposite to that on which the cover 14 is hinged, and comprises a support block 18 which is mounted into the exterior of the side wall 16 by suitable means, such as by a screw 20 extending through an aperture in the side wall 16 into engagement with a threaded hole in the block. The block also has a lock receiving aperture 22 extending perpendicular to the screw, which has a lower large portion 24 and an upper smaller portion 26 forming a shoulder 28.

Hinged to the support block 18 at the outer rear corner 29, is a lock housing 30, which comprises side walls 32, an end wall 34, and a box cover retainer 36 extending from the end wall in a position to extend in front of the cover when the housing is in the closed position. (See FIG. 1).

A lock sleeve 38 is press fitted or otherwise assembled and retained in a suitable aperture in the end wall 34, said sleeve having a central opening 40 which, when the housing is in the closed or locking position, is aligned with the aperture 22 in the support block 18.

The housing and support block are designed to receive a barrel lock 42 of the type having an enlarged heat 44 at one and a pair of retractable locking members 46 near the other end. Barrel locks of this type are well known in the art, and one illustration and description in U.S. Pat. No. 4,254,647.

The sleeve 38 has an outer portion 48 which is larger than the lower portion, to receiver the head 44 of the lock, and forming a shoulder 50, and the components are so dimensioned that when the head of the barrel lock is seated on the shoulder 50, the locking members 46 can extend closely behind the shoulder 28, thereby locking the housing in the closed position. When so locked, the box cover retainer 36 extends in front of the edge of the cover 14, preventing the cover from being opened.

The cover 14 may be opened by removing the barrel lock with a suitable key (not shown), and swinging the housing from the meter box as illustrated in FIG. 4. Unlocking of the box may thereby be accomplished without removal from the box of any of the components except the barrel lock.

Although in the illustrated embodiment of the invention the housing is formed of heavy gage sheet metal, if desired it may be formed by other methods such as casting.

Since certain changes apparent to the skilled in the art can be made in the herein illustrated embodiment of the invention, it is intended that all matter contained herein be interpreted in an illustrive and not a limiting sense.

I claim:

1. A lock housing assembly for attachment to a container having a cover to receive a lock of the barrel lock type to enable said assembly to retain the cover in the closed condition, said assembly comprising a support block for attachment to a side wall of the box and a cover retainer hinged to the support block so as to be pivotable toward and away from the side wall of the box in a plane perpendicular to that of the cover between a locking position in which a portion of the cover retainer is positioned in the path taken by the adjacent edge of the cover when the cover is opened and an unlocking position in which said portion is out of said path, said cover retainer and said support block having openings which become aligned only when said cover retainer is in the locking position, said aligned openings being dimensioned to receive, when aligned, a barrel lock to lock said cover retainer and said support block against relative movement.

2. A lock housing assembly as set out in claim 1 in which said housing comprises side portions which overlap the support block when the housing is in the locking position.

3. A lock housing retainer assembly for attachment to an electric meter box or other container having a cover, to retain said cover in the closed condition, said assembly being intended to receive a lock of the barrel-lock type and comprising a support block, means for attaching said block to an exterior wall of the block and a lock housing having a cover retainer attached to the block at a pivot so positioned that the housing can be pivoted in a plane perpendicular to that of the cover between a closed or locking position in which the cover retainer is positioned in front of the cover to prevent it from being opened and an open or unlocking position in which the cover retainer is not in front of the cover, said support block having a lock receiving opening and said housing having a lock receiving opening, said openings being positioned to be aligned only when the housing is in the closed or locking position.

4. A lock housing assembly as set out in claim 3 in which said housing is pivoted to the support block at the position thereof which is most remote from the box cover and the exterior wall.

5. A lock housing assembly for receiving a lock of the barrel-lock type, said assembly comprising a support block for attachment to a container having a cover, said block having an aperture for receiving an end of the barrel lock and having an internal shoulder for engaging locking elements of the lock, and a lock housing mounted on the support block by a hinge so positioned that the housing can be pivoted between a locking and an unlocking position in a plane perpendicular to the cover, said housing having a lock receiving opening which is aligned with the aperture only when the housing is in the locking position, and a cover retainer on the housing, said cover retainer extending form the housing closely in front of the cover when the housing is in the locking position.

* * * * *